United States Patent [19]

Dumusc

[11] Patent Number: 4,626,117

[45] Date of Patent: Dec. 2, 1986

[54] TYPEWRITER

[75] Inventor: Pierre Dumusc, Yverdon, Switzerland

[73] Assignee: Hermes Precisa International S.A., Yverdon, Switzerland

[21] Appl. No.: 260,803

[22] Filed: May 5, 1981

[30] Foreign Application Priority Data

May 20, 1980 [CH] Switzerland ..... 3916/80

[51] Int. Cl.[4] ..... B41J 29/18

[52] U.S. Cl. ..... 400/716; 400/690.1

[58] Field of Search ..... 400/716, 690.1, 690.2, 400/711, 693

[56] References Cited

U.S. PATENT DOCUMENTS 731,564 6/1903 Halle ..... 400/716
1,727,377 9/1929 Meinecke ..... 400/690.1 X
3,135,372 6/1964 Baughman ..... 400/716 X
3,720,298 3/1973 Alonas et al. ..... 400/716
4,063,630 12/1977 Crowe et al. ..... 400/144.2

*Primary Examiner*—Charles A. Pearson

[57] ABSTRACT

A typewriter comprises a carriage (1) sliding parallel to a platen (3). The typing device (2) operates in a printing zone which is displaced along this platen (3).

The casing (7) of the machine is open above the platen (3) and has a transparent anti-noise hood (10) covering its opening (8).

In order to facilitate the reading of the last line of type across the hood (10) which absorbs a part of the light, the typewriter is provided with means for illuminating the platen (3). These illumination means are constituted by electric bulbs (17) either carried by a transparent slide (14) housed in a U-shaped throat (12) or lie in the direction of the platen (3).

3 Claims, 4 Drawing Figures

TYPEWRITER

The present invention relates to a typewriter comprising a platen adapted to receive the paper on which type appears and a carriage displaceable along this platen and carrying a typing device.

Office typewriters are more and more frequently provided with a transparent hood, formed of synthetic material, disposed in front of the platen and covering the upper open part of the machine casing. This hood is adapted to absorb most of the noise emitted by the typing device. This anti-noise hood has, however, the disadvantage of absorbing a part of the light illuminating the typewriter, which is annoying when the user wishes to re-read the last line of type through this hood, more particularly as reflections are formed on the surface of this latter.

It is an object of the invention to provide a typewriter which permits the easy reading of the last line of type, despite the presence of an anti-noise hood. To this end, the typewriter forming the subject of the invention is characterized in that it comprises means for illuminating the zone where the typing is effected.

The luminosity provided by the illuminating means compensates for the absorption of light due to the anti-noise hood. Moreover, since the luminosity occurring in the typing zone under the anti-noise hood is substantially equal to or greater than the surrounding luminosity in which the machine is placed, then the reflections on the hood become practically imperceptible to the user.

The present invention will be further illustrated, by way of example, with reference to the accompanying drawing, in which.

Figure 1:
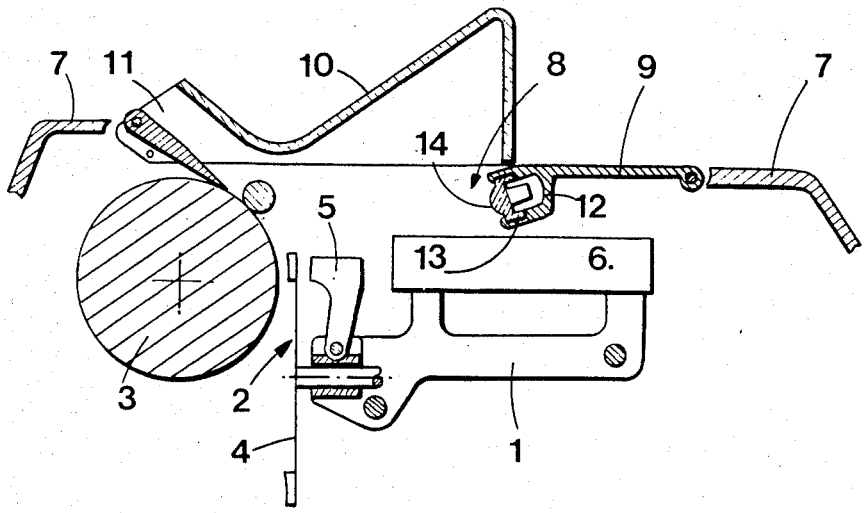
FIG. 1 is a partial view, in section, of a typewriter in accordance with the invention.

The typewriter illustrated in FIG. 1 comprises a carriage 1 carrying a typing device 2 which is displaceable along a platen 3.

The device 2 comprises a printing disc 4, a hammer 5 and an inked ribbon cassette 6.

The casing 7 of the machine is provided, in front of the platen 3 and above the carriage 1, with an opening 8 extending over the whole of the width of the platen 3.

A foldable guard 9, pivoting on the casing 7 along an axis parallel to the platen 3, partially covers the opening 8. A transparent anti-noise hood 10, pivoted adjacent the platen 3, is adapted to bear on the edge of the guard 9 and covers the rest of the opening 8 whilst leaving a passage 11 for sheets of paper disposed around the platen 3.

Access to the cassette 6, so as to replace it, is obtained by lifting the hood 10 and the guard 9 pivoting them upwardly around their pivotal axes. The guard 9 is provided, along its side opposite the platen 3, with a longitudinal rib forming a U-shaped throat 12, the opening of which is oriented in the direction of the platen 3. The two sides opposite the throat 12 each present a longitudinal groove 13 serving to fix a transparent slide 14.

Figure 2:
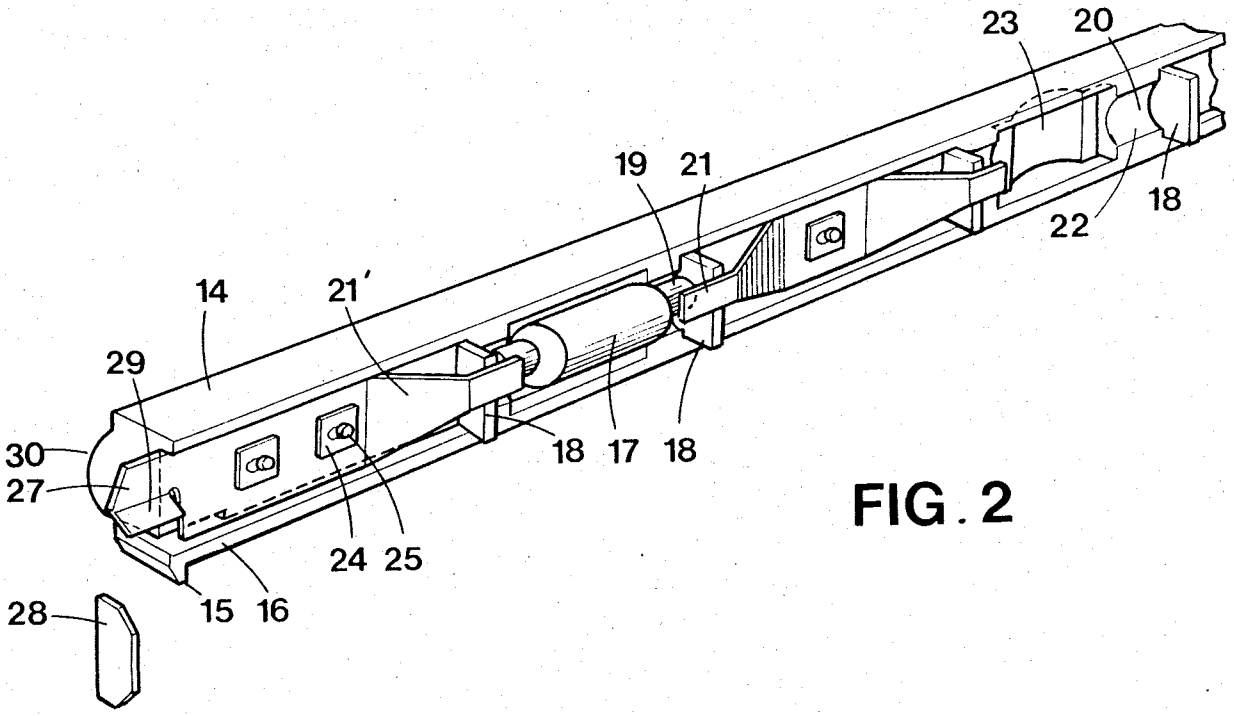
FIG. 2 is a perspective view, on an enlarged scale, of a detail of FIG. 1.

The slide 14, illustrated on a larger scale in FIG. 2, is slid into the throat 12 from one on the ends of the guard 9. The two ends of the slide 14 are each provided with a retaining member 15 carried by an elastic tongue 16 which members hook themselves on the edges of the guard 9 to lock the slide 14 longitudinally in the throat 12. The surface of the slide 14 facing the bottom of the throat 12 carries several electric bulbs 17 of elongated form. As illustrated in FIG. 2, each bulb 17 is housed between two partitions 18, integrally formed with the slide 14, and the ends 19 of the bulb, forming electrical connection contacts, are maintained against bearings 20 by metallic straps 21.

The bearings 20 present a cylindrical hollow 22 confirming to the shape of the ends 19 of the bulb 17 on one portion of their periphery. The slide 14 presents, between the two bearings 20, a cavity 23 forming a cylindrical lens and the generatrices of which are orientated perpendicularly to the longitudinal axis of the slide 14. This cavity 23 has the effect of distributing, over a portion of the length of the slide, the luminous rays emitted by the bulb 17.

The metallic straps 21 are fixed on the slide 14 by means of snap members 24 each member 24 holding a lug 25 passing through a corresponding hole of the strap 21. These straps bear resiliently on the ends of two successive bulbs 17 against the corresponding bearings 20 and moreover ensure the electrical connection of the bulbs 17. These bulbs 17 are connected in series and the straps 21', disposed at the ends of the slide 14, each have a portion 27 overrunning the said ends and adapted to come into contact with an electrical connection foot 28 fixed against the casing 7 of the typewriter.

Electrical contact is established when the guard 9 is lowered, as shown in FIG. 1. When this guard 9 is raised, for example to replace a cassette 6, the electrical contact is cut. In order to facilitate the placing of the members 27 against the terminals 28, the members 27 have an inclined border 29 forming a ramp.

The surface 30 of the slide 14, facing in the direction of the platen 3, is extended along the longitudinal axis of the slide 14, in a manner to produce a convex lens effect and to concentrate the luminous rays emitted by the bulbs 17 into a flattened beam directed towards the platen 3, over the whole zone of the platen 3 corresponding to a line of type.

The illumination of the platen 3 greatly facilitates reading across the anti-noise hood 10. This illumination compensates for the absorption of the light by the hood 10 and reduces the perception that a user can have of reflections which form on this hood 10.

One can, of course, conceive providing a typewriter not having an anti-noise hood 10 with platen illuminating means. Such a machine could be disposed in an office without the user needing to take into account the position of the windows or the artificial sources of light for orientating the machine.

One could envisage providing a typewriter comprising illuminating means limited to illuminating the zone where the typing is effected. One could to this end dispose a source of light on the carriage 1.

Figure 3:
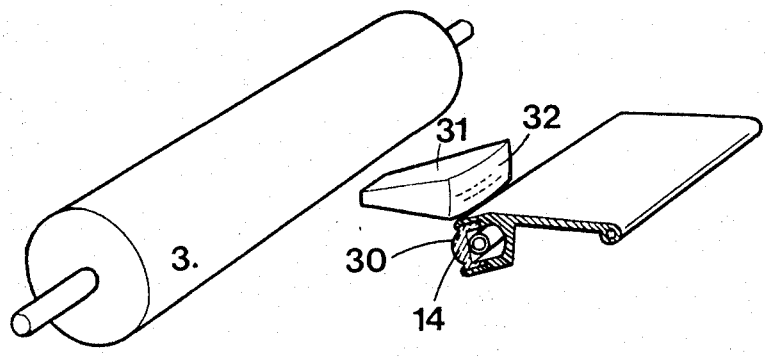
FIG. 3 is a partial view, in perspective, of a first embodiment of the typewriter of the invention.

FIG. 3 partially illustrates an embodiment of the typewriter described with reference to FIGS. 1 and 2. This machine comprises means for concentrating a part of the luminous rays of the light beam around the typing zone. These means are constituted by a transparent prism 31 which is carried by the carriage 1 and is displaced into the light beam. The large base 32 of the prism 31, facing in the direction of the slide 14, is convex to make the rays which cross through it converge towards the small base, disposed opposite the platen 3. The lateral surfaces of the prism can be opaque to avoid formation of reflections.

Figure 4:
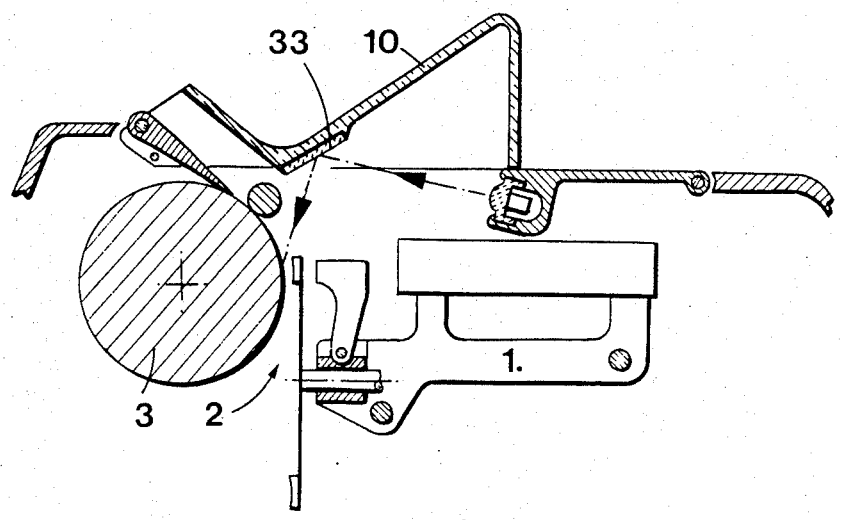
FIG. 4 is a partial view, in transverse section, of a second embodiment.

One could also envisage, as shown in FIG. 4, illuminating the platen by a luminous beam reflected by a reflecting surface of the anti-noise hood 10, for example a mirror 33 fixed against its inner surface. The luminous beam is reflected against the platen from above and is not intercepted by the typing device 2 carried by the carriage. This arrangement has the advantage of avoiding the formation of shadows projected against the platen 3. The mirror 33 is substantially parallel to the axis of view of a user and, due to the fact, is practically not visible by the user. On the other hand, this mirror 33 is dispensible and one could be faced with the reflection obtained against the lower surface of the hood 10 when the luminous beam impinges this surface practically tangentially, that is to say with a high angle of incidence.

I claim:

1. A typewriter comprising a casing having an opening in the upper part thereof, a platen to receive the paper to be written on, a carriage movable along said platen and a writing device on said carriage, a guard pivotally mounted at its rear edge on said casing and covering a first portion of said opening when in a lowered position, said guard including a front edge facing said platen, stationary lighting means for illuminating the area where the writing is to be performed and also to illuminate the entire length of said platen, said lighting menas including at least one substantially linear light source, a transparent slide removably secured to the front edge of said guard opposite said platen, said at least one light source mounted in said transparent slide, said stationary lighting means including an optical system integral with said transparent slide and adapted to pick up the rays from said light source and direct them toward said platen in the form of a flat beam, said slide including electrical connections for said light sources, electrical connection means mounted on said casing, whereby electrical contact is made between said electrical connections on said slide and said electrical connection means on said casing when said hinged guard is in a lowered position and broken when the guard is in a raised position.

2. A typewriter according to claim 1 wherein, said carriage includes a transparent prism mounted thereon that picks up a portion of the rays from the light source to make them converge in the area where the carriage performs the writing.

3. A typewriter according to claim 1 including, a transparent, anti-noise hood covering a second portion of said opening in said housing, wherein said light source directs light rays against a partially reflective surface of the transparent parent hood and against said platen.

* * * * *